US005094134A

United States Patent [19]

Mizukoshi

[11] Patent Number: 5,094,134

[45] Date of Patent: Mar. 10, 1992

[54] CUTTING PEN

[75] Inventor: Toshiya Mizukoshi, Kamimura, Japan

[73] Assignee: Roland DG Corporation, Shizuoka, Japan

[21] Appl. No.: 535,052

[22] Filed: Jun. 8, 1990

[51] Int. Cl.[5] ..... B26D 3/08

[52] U.S. Cl. ..... 83/700; 83/879; 33/18.1; 403/165; 81/DIG. 1

[58] Field of Search ..... 83/861, 879, 880, 700; 33/18.1, 18.2, 32.3; 81/177.85, DIG. 1; 403/164, 165; 101/127.1, 128.1

[56] References Cited

U.S. PATENT DOCUMENTS

| | | | |
|---|---|---|---|
| 2,466,243 | 4/1949 | Johnson | 403/164 |
| 2,810,960 | 10/1957 | Johnson et al. | 33/18.1 |
| 2,902,760 | 9/1959 | Koenig | 33/18.1 |
| 3,593,426 | 7/1971 | Domagalski . | |
| 3,655,226 | 4/1972 | Cowan | 403/165 |
| 3,818,597 | 6/1974 | Schmied | 33/18.1 |
| 4,166,488 | 9/1979 | Irby | 81/177.85 |
| 4,367,588 | 1/1983 | Herbert . | |
| 4,524,894 | 6/1985 | Leblond | 83/879 |
| 4,537,582 | 8/1985 | Liu . | |
| 4,794,698 | 1/1989 | Fassett, II . | |

FOREIGN PATENT DOCUMENTS 2-78171 6/1990 Japan .

*Primary Examiner*—Frank T. Yost
*Assistant Examiner*—Scott A. Smith
*Attorney, Agent, or Firm*—Sandler, Greenblum, & Bernstein

[57] ABSTRACT

A cutting pen with a bar-shaped cutter having a blade portion at one end thereof and a cylindrical holder into which the bar-shaped cutter can be inserted from the other end of the bar-shaped cutter. The holder has a radial bearing disposed corresponding to one end of the bar-shaped cutter and a thrust bearing disposed corresponding to the other end to support the inserted bar-shaped cutter in such a manner as to allow rotation around the axis thereof. The cylindrical holder attracts and holds therein the bar-shaped cutter by magnetic attraction, in such a manner that the work of attaching and/or detaching the bar-shaped cutter can be performed simply and easily in a short time, and the bar-shaped cutter is held firmly preventing it from falling off the cylindrical holder during use of the cutting pen.

17 Claims, 2 Drawing Sheets

CUTTING PEN

BACKGROUND OF THE INVENTION

1. Field of the Invention

The present invention relates to a cutting pen used in a cutting apparatus reproducing the content of an image by cutting a sheet based on image information.

2. Description of the Related Art

The following description relates to a cutting apparatus using a cutting pen.

FIG. 1 is a schematic view showing an entire cutting apparatus 10. In FIG. 1, image information from an image scanner 11, which reads a dot pattern on the pixcel basis, is supplied to a microcomputer 12 through a bus 13 under control of the microcomputer 12. This microcomputer 12 is provided with a central processing unit (CPU) 12A which executes a predetermined program, a read-only memory (ROM) 12B storing this program, and a random-access memory (RAM) 12C as a working memory containing various registers which are to be assigned in performing an arithmetic operation required for executing this program and as a memory in which image information from the above-described image scanner 11 is written. Then, by processing the image information written to this RAM 12C based on the above-mentioned program, the content of an image is cut from a sheet by means of a sheet cutter 14.

As shown by line cuts FIG. 2, this sheet cutter 14 cuts, in the content of the image by moving the sheet 25 back and forth by means of rollers which are attached to a platen 26 in the y-axis direction with respect to the sheet 25 and by simultaneously moving a cutting tool 27 right and left in the x-axis direction with respect to the sheet 25.

Then, a cutting pen 28 for line-cutting is attached to this cutting tool 27, and cutting pen 28 being used in a manner described above in the cutting apparatus 10.

On the other hand, the cutting pen 28 is configurated such that a bar-shaped cutter is supported and rotatably held around the axial line thereof, in a cylindrical holder so that the content of the image can be line-cut freely from the sheet 25. The following are known structures of this kind of holding configuration:

1. Configuration wherein the cylindrical holder is filled with grease, the bar-shaped cutter is inserted into this holder filled with grease and the bar-shaped cutter is held by adhesion of the grease; and 2. A configuration wherein movement of the bar-shaped cutter in the direction of the axial line is supported by a pivot bearing installed at the bottom part in the cylindrical holder, and an O-ring disposed in a manner fitted to the bar-shaped cutter between two miniature bearings fitted to the opening end in this cylindrical holder, and thereby holding the bar-shaped cutter is.

However, in attaching or detaching the bar-shaped cutter to or from the cylindrical holder due to a damage of the edge tip or the like, the former known structure has a problem in that the grease adheres to operator's hands and the cylindrical holder, resulting in a difficult in the attaching or detaching operation or a drop-off of the bar-shaped cutter during the use. Also, the latter known structure has a problem in that the diameter of the O-ring cannot be made large in order to prevent it from dropping off the bar-shaped cutter. Thus fitting or detaching the bar-shaped cutter to or from the O-ring is difficult, and further, this form of configuration requires a large number of parts, resulting in a higher cost.

SUMMARY OF THE INVENTION

An object of the present invention is to provide a cutting pen which facilitates the attaching and detaching of a cutter to or from a holder so that the cutter can be reliably held by the cutter without dropping off the holder.

To achieve the above-described object, a cutting pen in the present invention is provided with a bar-shaped cutter having a blade portion at one end thereof, and a cylindrical holder into which the other end of the bar-shaped cutter can be inserted. The inside of the cylindrical holder is provided with at least a radial bearing in correspondence with one end of the bar-shaped cutter and a thrust bearing in correspondence with the other end to support the inserted bar-shaped cutter in a manner capable of rotation around the axial line thereof.

The above-mentioned cylindrical holder attracts and holds therein the bar-shaped cutter by means of magnetic force.

Accordingly, the attaching and detaching of the bar-shaped cutter can be performed simply and easily in a short period of time, and the bar-shaped cutter can be held reliably so as not to fall from the cylindrical holder during use.

In accordance with one embodiment of the present invention, the bar-shaped cutter is made of a magnetized material, and the above-mentioned thrust bearing is also made of a magnetic material, whereby the cylindrical holder attracts and holds their the bar-shaped cutter by magnetic attraction. In accordance with another embodiment, the bar-shaped cutter is made of a magnetic material, and the thrust bearing is made of a magnetized material, whereby the cylindrical holder attracts and holds therein the bar-shaped cutter by magnetic attraction.

DETAILED DESCRIPTION OF THE PREFERRED EMBODIMENTS

The following embodiments of a cutting pen in accordance with the present invention are described hereinafter refering to the drawings.

In a first embodiment of a bar-shaped cutter, there is provided a magnetized member.

Figure 1:
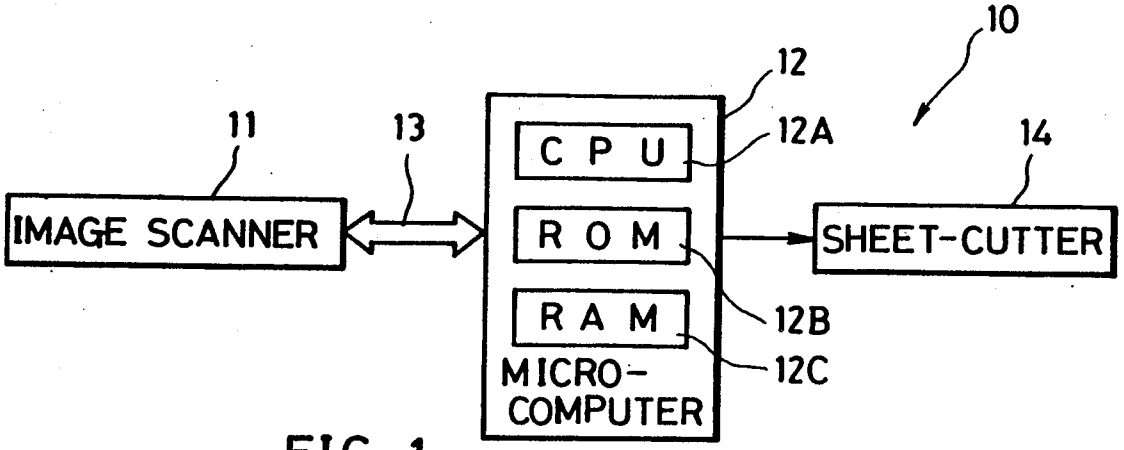
FIG. 1 is a schematic block diagram of a sheet cutting apparatus.
Figure 2:
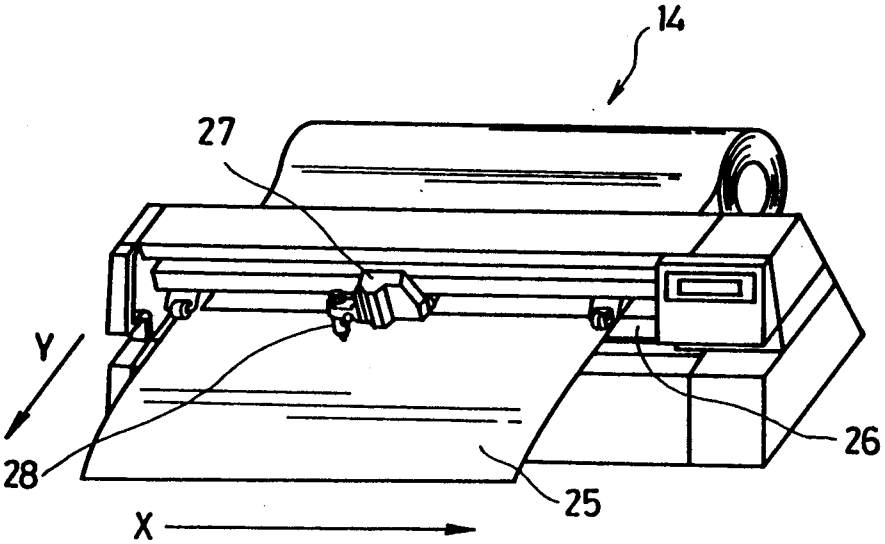
FIG. 2 is a perspective view of a sheet cutter incorporated in the sheet cutting apparatus.
Figure 3:
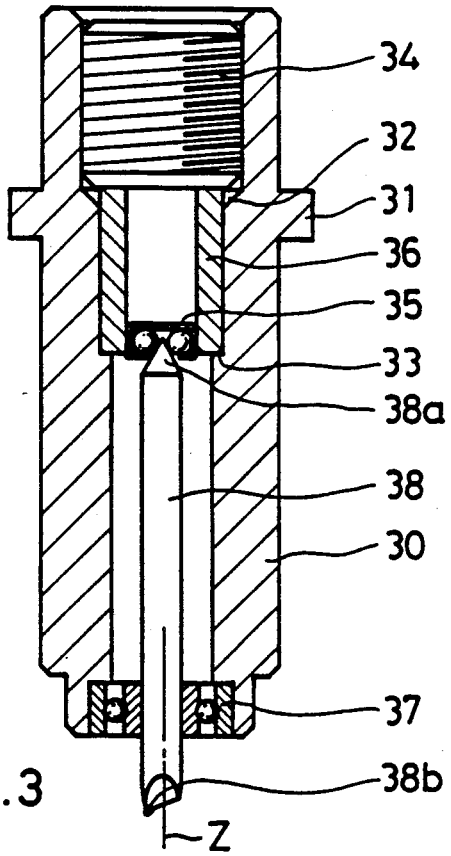
FIGS. 3 and 4 are cross-sectional views of each cutting pens in embodiments of the present invention.

In FIG. 3, a flange 31 engaging a cutting tool (not illustrated) is provided in a protruded fashion on an outer peripheral part of a cylindrical holder 30 made of a non-magnetic material such as aluminum or aluminum alloy. Double-stepped parts 32 and 33 are formed so that the inner space of the cylindrical holder 30 becomes narrower in the downward direction, and are positioned at the upper end of the inner peripheral part of this cylindrical holder 30. Inserted in the upper space of the cylindrical holder 30 having these double-stepped parts 32 and 33 are a set screw 34, a cylindrical pivot holder 36, and a pivot bearing 35 is provided as the thrust bearing and is made of a magnetic substance. The pivot bearing 35 is fitted in the lower end of the holder 36 in a vertical position as illustrated, and is secured to the holder 36 by means of an adhesive so as to form an integral member which is set by the set screw 34. Accordingly, the pivot bearing 35 can be adjusted vertically by setting the screw 34 within a range down to the lower end point where the set screw 34 and the pivot holder 36 contact the stepped parts 32 and 33 respectively. Also, a miniature bearing 37 is provided as a radial bearing and is fitted in the lower end of the inner peripheral part of the cylindrical holder 30.

A bar-shaped cutter 38 has a main body which is made of a magnetic steel or the like and is magnetized. The cutter 38 is provided with a conical pivot 38*a*, and is supported at the upper end thereof by the pivot bearing. The cutter 38 further is provided with a blade portion 38*b* which is formed by bonding a tip of superalloy, high-speed steel or sapphire at the lower end of the main body.

In addition, the tip end of the blade 38*b* is offset with respect to an axis Z of the bar-shaped cutter 38. The bar-shaped cutter 38 is journaled at the upper end thereof by the pivot bearing 35, and at the lower end by the miniature bearing 37, free from any deviation from the center. Thus cutter 38 is held by the cylindrical holder 30 in a manner capable to allow rotation around the axis 3. Additionally the magnetic force between magnetized bar-shaped cutter 38 and pivot bearing 35, made of the magnetic substance prevents the cutter 38 from falling from the holder 30.

The bar-shaped cutter 38 can only be mounted by upwardly inserting pivot 38*a* through the inner race of the miniature bearing 37, and subsequently being automatically set in position by the magnetic force between the pivot bearing 35 and the bar-shaped cutter 38. In this case, when the position of the tip end of the bar-shaped cutter 38 needs to be adjusted with respect to the sheet which is to be cut, positioning of the pivot bearing 35 need only be made by setting the set screw 34.

Although in this embodiment the pivot bearing 35 is used as the thrust bearing, it is also possible to use a metal bearing, a plate having a press-indented point, or the like as the support for the pivot 38*a* in place of the pivot bearing 35.

In another embodiment, the thrust bearing is a magnetized member. Description here will be made merely on such portions differing from those in the first embodiment, wherein the same numerals as in the first embodiment denote the same members.

Figure 4:
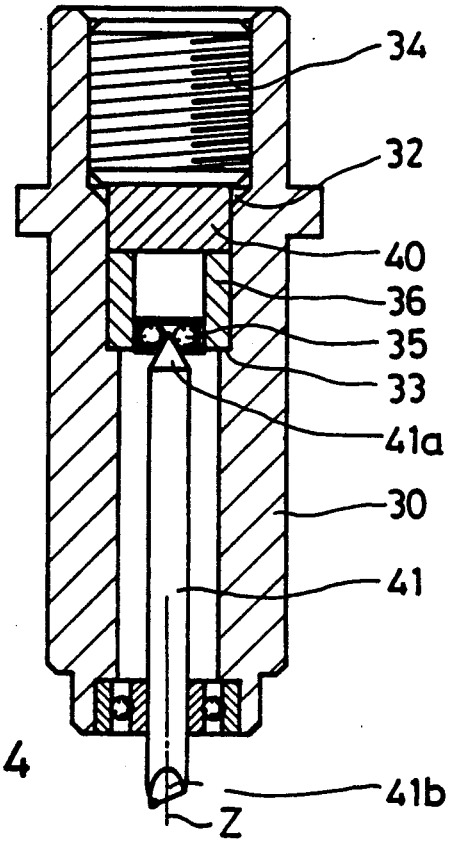

In FIG. 4, disposed in the upper space of cylindrical holder 30 having double-stepped parts 32 and 33, are a set screw 34, a magnetized columnar magnet 40 and a cylindrical pivot holder 36. In the lower end holder 36, pivot bearing 35, made of a magnetic substance is provided as the thrust bearing and is fitted coaxially in a vertical direction wherein these members are fixed to each other by an adhesive to form an integral body, which is set by the set screw 34. In this case, the pivot bearing 35 is magnetized by the magnet 40.

Unlike the first embodiment using the magnetized bar-shaped cutter 38, a bar-shaped cutter 41 in this embodiment is provided with a main body made of a magnetic substance such as carbon steel or the like. The cutter 41 has a pivot 41*a* at the upper end thereof and a blade portion 41*b* at the lower part thereof, similar to the first embodiment. The bar-shaped cutter 41 is held by the cylindrical holder 30 in such a manner as to allow rotation around the axis 3, and due to the attracting force exerted between the magnetic bar-shaped cutter 41 and the magnetized pivot bearing 35 the cutter 41 is prevented from dropping off of the cutter 41.

Although in this embodiment pivot bearing 35 is made of a magnetic substance and is magnetized by the magnet 40, it is possible to employ, in a modification of the this embodiment a pivot bearing 35 made of magnetic steel or the like which magnetized.

In still another modification, the pivot bearing 35 can be made of a non-magnetic substance, and the bar-shaped cutter 41 is attracted to the pivot bearing 35 by magnetic fluxes of the magnet 40.

Although in the above-mentioned embodiments, the cutting edge is attached directly to the blade portion 38*b* or 41*b* of the bar-shaped cutter 38 or 41, it is also possible to attach the cutting edge by screws or the like.

What is claimed is:

1. A cutting pen comprising:
   - a bar-shaped cutter having an edged part at one end and a conical pivot at another end;
   - a cylindrical holder adapted to receive another end of said bar-shaped cutter;
   - a radial bearing disposed in said cylindrical holder at a position corresponding to said one end of said bar-shaped cutter;
   - a thrust bearing comprising a pivot bearing disposed in said cylindrical holder at a position corresponding to said other end of said bar-shaped cutter to support said bar-shaped cutter after insertion in said cylindrical holder, adapted to permit rotation of the cutter around an axis thereof, wherein said cylindrical holder attracts and holds said bar-shaped cutter by magnetic attraction.

2. A cutting pen in accordance with claim 1, wherein said bar-shaped cutter is made of a magnetized material, and said thrust bearing is made of a magnetic substance, and further wherein said cylindrical holder attracts and holds said bar-shaped cutter by magnetic attraction.

3. A cutting pen in accordance with claim 1, wherein said bar-shaped cutter is made of a magnetic substance, and said thrust bearing is made of a magnetized material, and further wherein said cylindrical holder attracts and holds said bar-shaped cutter by magnetic attraction.

4. A cutting pen in accordance with claim 1, further comprising means for adjusting said thrust bearing wherein the position of said thrust bearing is adjustable in said cylindrical holder in the axial direction from behind.

5. A cutting pen in accordance with any of claim 1, wherein a cylindrical main body of the cylindrical holder comprises a non-magnetic material.

6. A cutting pen in accordance with claim 1, wherein said cutting pen is mechanized.

7. A cutting pen in accordance with claim 6, wherein said cutting pen is automatic.

8. A cutting pen for a cutting apparatus comprising:
   - a bar-shaped cutter having an edge part on a first end;
   - a cylindrical holder adapted to permit the insertion of a second end of said bar-shaped cutter, wherein said first end of said bar-shaped cutter extends externally from said cylindrical holder;
   - means for preventing deviation of said first end of said bar-shaped cutter from a center axis of said bar-shaped cutter; and
   - means to magnetically support said second end of said bar-shaped cutter in said cylindrical holder,
   - said means to magnetically support comprising a thrust bearing adapted to engage said second end of said bar-shaped cutter inserted in said cylindrical holder, wherein said thrust bearing is further adapted to permit rotation of said bar-shaped cutter around said center axis of said bar-shaped cutter, and further wherein said bar-shaped cutter is further provided with a conical pivot adapted to be engaged with said thrust bearing.

9. A cutting pen for a cutting apparatus according to claim 8, wherein said means for preventing deviation further comprises at least one radial bearing adapted to engage said bar-shaped cutter in said cylindrical holder, relative to a position where said bar-shaped cutter externally extends from said cylindrical holder.

10. A cutting pen for a cutting apparatus according to claim 8, wherein said bar-shaped cutter is comprised of a magnetized material, and said thrust bearing is comprised of a magnetic substance.

11. A cutting pen for a cutting apparatus according to claim 8, wherein said bar-shaped material is comprised of a magnetic substance and said thrust bearing is comprised of a magnetized material.

12. A cutting pen for a cutting apparatus according to claim 8, further comprising means for adjusting an axial position of said thrust bearing in said cylindrical holder.

13. A cutting pen for a cutting apparatus according to claim 12, wherein said means for adjusting comprises a set screw adapted to be in contact with said thrust bearing.

14. A cutting pen for a cutting apparatus according to claim 8, wherein said thrust bearing is a pivot bearing.

15. A cutting pen for a cutting apparatus according to claim 8, wherein a cylindrical body of said cylindrical holder is comprised of a non-magnetic material.

16. A cutting pen in accordance with claim 8, wherein said cutting pen is mechanized.

17. A cutting pen in accordance with claim 16, wherein said cutting pen is automatic.

* * * * *